US005263516A

United States Patent [19]

van Schuylenburch

[11] Patent Number: 5,263,516

[45] Date of Patent: Nov. 23, 1993

[54] THREE-DIMENSIONAL WOVEN STRUCTURE

[76] Inventor: Derck W. P. F. van Schuylenburch, EZ-8 Motel, 2434 W. Hollcrest Dr., Newbury Park, Calif. 91320

[21] Appl. No.: 520,040

[22] Filed: May 7, 1990

[51] Int. Cl.[5] ..... D03D 11/00

[52] U.S. Cl. ..... 139/411; 139/DIG. 1; 139/384 R; 428/225; 428/364; 428/365; 428/257

[58] Field of Search ..... 428/224, 225, 226, 227, 428/228, 113, 255, 257, 408, 364, 365; 139/DIG. 1, 411, 384 R

[56] References Cited

U.S. PATENT DOCUMENTS

| | | | |
|---|---|---|---|
| 3,322,868 | 5/1967 | Kruse et al. | 264/45 |
| 3,749,138 | 7/1973 | Rheaume et al. | 139/408 |
| 3,904,464 | 9/1975 | King | 156/148 |
| 4,001,478 | 1/1977 | King | 428/257 |
| 4,131,708 | 12/1978 | Moores et al. | 428/257 |
| 4,218,276 | 8/1980 | King | 156/92 |
| 4,219,597 | 8/1980 | Maistre | 428/105 |
| 4,257,835 | 3/1981 | Bompard | 156/92 |
| 4,336,296 | 6/1982 | Fukuta et al. | 428/257 |
| 4,370,390 | 1/1983 | Burk | 428/614 |
| 4,379,798 | 4/1983 | Palmer et al. | 428/113 |
| 4,448,832 | 5/1984 | Kidwell | 428/113 |
| 4,546,032 | 10/1985 | Vasilos | 428/223 |
| 4,686,134 | 8/1987 | Ono | 428/222 |
| 4,715,560 | 12/1987 | Loyek | 244/131 |
| 4,725,485 | 2/1988 | Hirokawa | 428/225 |
| 4,790,052 | 12/1988 | Olry | 28/110 |

*Primary Examiner*—Donald P. Walsh
*Assistant Examiner*—Ngoclan T. Mai
*Attorney, Agent, or Firm*—Poms, Smith, Lande & Rose

[57] ABSTRACT

A three-dimensional woven structure which exhibits isotropic mechanical and structural properties by incorporating the highest possible degree of interweavement of its fibers or rods comprising a plurality of adjacent sets of lateral rods or fibers, a plurality of adjacent sets of transverse rods or fibers and a plurality of adjacent sets of vertical rods or fibers. These lateral, transverse and vertical sets of fibers or rods come together substantially mutually perpendicularly to one another at a plurality of intersection nodes with each intersection node being formed in such a fashion that the lateral, transverse and vertical rods or fibers are fully interwoven with one another.

11 Claims, 8 Drawing Sheets 10
12
14
16
18
20

22
24
26
28
30
32

34
36
38
40
42
X
Y
Z

THREE-DIMENSIONAL WOVEN STRUCTURE

BACKGROUND OF THE INVENTION

1. Field of the Invention

The present invention relates to the geometrical configuration of woven three-dimensional structures, and more particularly to such structures which are adapted for use in high strength composite materials.

2. Description of the Prior Art

A wide variety of reinforced fiber or filament composite materials and structures are known in the art. Generally speaking, such structures consist of an array of fibers, filaments or rods embedded in a matrix-material which encases the fibers and fixes them into position. Any number of materials, including but not limited to glass, quartz, graphite, steel, asbestos and boron, may be used as fibers or filaments in such composite materials. Similarly, many materials, including plastics, ceramics and resins, to name just a few, may form the matrix-material.

A variety of woven structures are known. For example, U.S. Pat. No. 4,336,296 describes a three-dimensionally latticed flexible structure composite material suitable for absorbing repeatedly exerted external impacts. Similarly, U.S. Pat. No. 4,546,032 discloses a fiber reinforced composite structure exhibiting enhanced tailored anisotropic shear strength properties.

Additional reinforced composite structures which embody other characteristics and properties are also known. For example, U.S. Pat. No. 3,904,464 describes a process for producing, in billet form, a compact composite structure having inter-fiber frictionally based self-supporting three-dimensional integrity and enhanced structural strength properties. Also, structures involving non-mutually perpendicular elements and various net shapes, such as cylinders, cones and the like, as described in U.S. Pat. Nos. 4,379,798, 3,749,138 and 4,725,485, are well known. Further, structures allowing for joining of intersecting structural members, as in U.S. Pat. No. 4,715,560, are also known.

However, all of the prior art structures exhibit one or more of a number of problems and deficiencies. A principle deficiency is that none of the prior art structures, as more fully explained hereinbelow, exhibit a maximum degree of interweavement of fibers or filaments. Therefore, these fibers or filaments are not "interlocked" in all possible places. Consequently, all of the prior art structures exhibit various planes or axes of mechanical and structural weakness; i.e., they do not exhibit isotropic mechanical and structural strength characteristics. Moreover, because of this lack of mechanical strength isotropy, all of the prior art structures suffer from a need to be properly oriented when used in given applications. This creates problems for end users who must not only solve the problem of how to properly orient a material in a given application, but also contend with the various mechanical and structural weaknesses that exist in the structures' non-maximum strength planes and axes.

An additional problem with the prior art structures is that, because of their lack of maximum degree of fiber interweavement, they cannot provide the maximal degree of rigidity of which their fibers or filaments are capable.

A further problem is that, because their filaments are not maximally interlocked, none of the prior art structures can exist as a "self-maintaining" structure, absent an encasing matrix-material and a maximal degree of compactness.

SUMMARY OF THE INVENTION

Accordingly, a principal object of the present invention is to provide a three-dimensional woven structure which exhibits isotropic mechanical and structural properties by incorporating the highest possible degree of interweavement of its fibers or filaments.

A further object of the present invention is to provide a three-dimensional woven structure which incorporates no weak plane or axis, thereby eliminating the need to orient the material to suit the mechanical and structural strength needs of a given application.

Yet another object of the present invention is to provide a three-dimensional woven structure which can exhibit the maximum degree of rigidity of which its constituent fibers or filaments are capable.

Still another object of the instant invention is to provide a three-dimensional woven structure which can also be created as a self-maintaining, non-impregnated structure, one that furthermore can be created "non-compactly." (Such a "skeletal structure" is possible provided its constituent elements have some specified minimal bend resistance.)

In accomplishing these and other objects, there is provided a three-dimensional woven structure including a plurality of adjacent sets of lateral rods or fibers, a plurality of adjacent sets of transverse rods or fibers and a plurality of adjacent sets of vertical rods or fibers. These lateral, transverse and vertical sets of fibers or rods come together substantially mutually perpendicularly to one another at a plurality of intersection nodes with each intersection node being formed in such a fashion that the lateral, transverse and vertical rods or fibers are fully interwoven with one another. The lateral, transverse and vertical sets of fibers or rods are also seen to form three substantially mutually perpendicular interdistributed sets of planar weave patterns or fabrics. The coming together of the lateral, transverse and vertical sets of fibers in this fashion results in an isotropically interwoven three-dimensional structure which exhibits the isotropic mechanical and structural characteristics discussed herein.

Other objects, characteristics and advantages of the present invention will become apparent from a consideration of the following detailed description with reference to the accompanying drawings.

DETAILED DESCRIPTION OF THE PREFERRED EMBODIMENTS

Figures 1A, 1B, 1C:
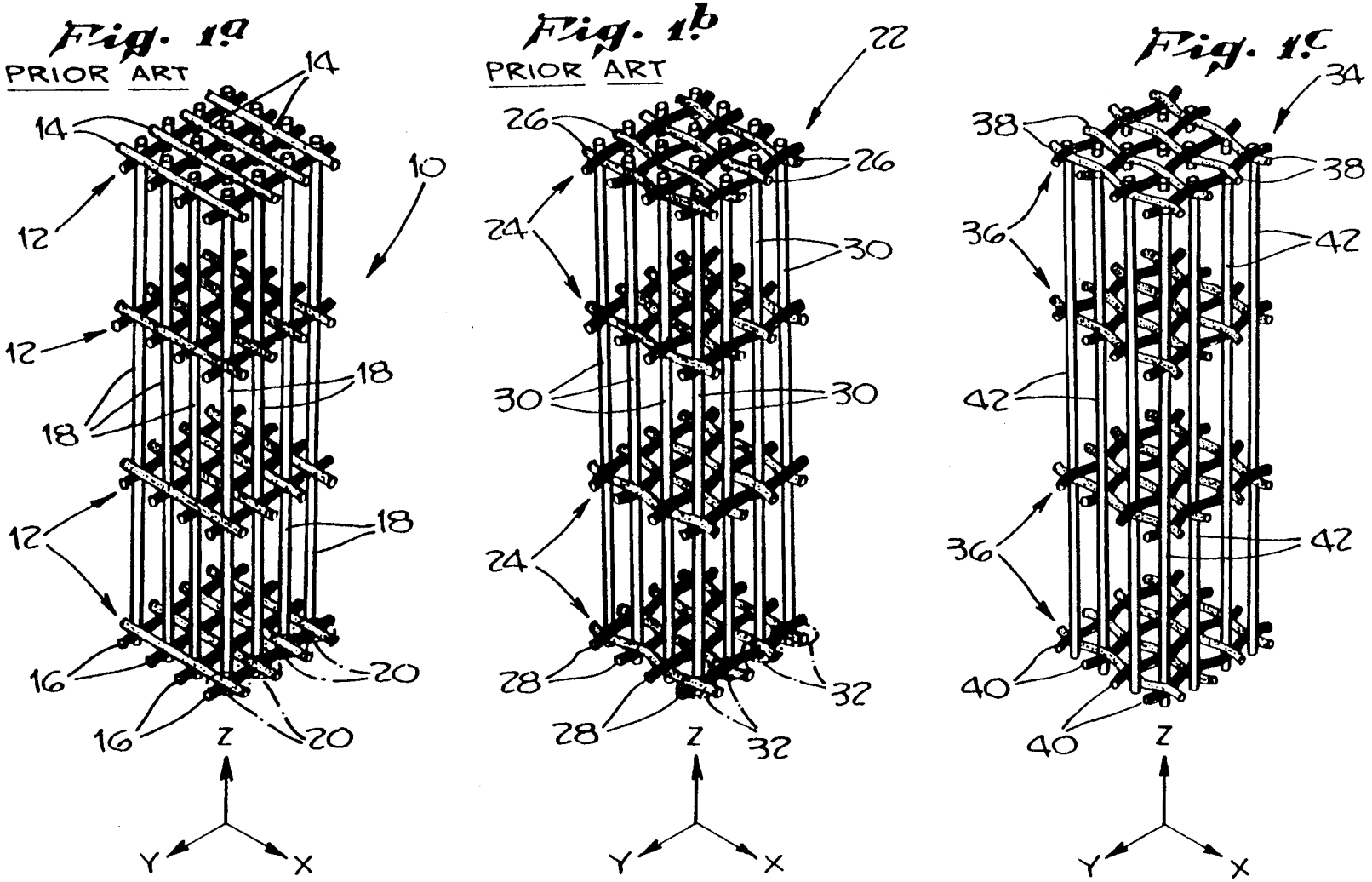
Fig. 1a PRIOR ART
Fig. 1b PRIOR ART
FIG. 1*a* is a schematic view, in perspective and exploded along one axis, of a non-interwoven three-dimensional structure.
FIG. 1*b* is a schematic view, in perspective and exploded along one axis, of a partially interwoven three-dimensional structure.
FIG. 1*c* is a schematic view, in perspective and exploded along one axis, of a fully interwoven three-dimensional structure illustrating the principles of the present invention.

Referring now to the drawings, FIGS. 1*a* and 1*b* provide schematic representations of the extent of interweavement exhibited by prior art three-dimensional structures. In FIG. 1*a* is shown a three-dimensional structure exhibiting the characteristics of a non-interwoven structure 10. Non-interwoven structure 10 contains four identical planar substructures 12, each substructure 12 consisting of four coplanar elements 14 extending generally in what is designated as the X-direction, and four coplanar elements 16 extending generally in what is designated as the Y-direction. X- and Y- direction elements 14, 16 are substantially perpendicular to one another.

The four planar substructures 12 are interconnected or stitched together by sixteen substantially parallel elements 18, not all of which are shown in their entirety, extending generally in what is designated as the Z-direction. The Z-direction elements 18 are substantially perpendicular to X- and Y-direction elements 14, 16. Non-interwoven structure 10 is shown expanded in the Z-direction for purposes of clarity. The non-interwoven nature of the structure 10 is seen by examining the extent of interweavement, or lack thereof, exhibited by X-, Y- and Z-direction elements 14, 16 and 18. Thus, in FIG. 1*a* it is seen that each X-direction element 14 in a given substructure 12 extends in that substructure in such a way that it is always on the same side of the plane defined by the Y-direction elements 16 in that substructure. Simultaneously, and as a necessary corollary to the orientation of the X-direction elements 14, each Y-direction element 16 in a given substructure extends in that substructure 12 so that it is always on the same side of the plane defined by the X-direction elements 14 in that substructure. Hence, it is understood that the X- and Y-direction elements 14, 16 in each substructure 12 exhibit no interweavement with one another.

Further, in FIG. 1*a* it is seen that Z-direction elements 18 extend in non-interwoven structure 10 so that any given Z-direction element 18 intersects each planar substructure 12 at the same location in each of the planes defined by the X- and Y-direction elements of each substructure. Stated differently, each Z-direction element 18, as it traverses non-woven three-dimensional structure 10, passes through successive substructures 12 without shifting position relative to intersections 20 defined by the crossing of X- and Y-direction elements 14, 16 in a given substructure 12: i.e., Z-direction elements 18 pass "straight" through substructures 12 and therefore exhibit no interweavement with either X-direction 14 or Y-direction 16 elements. Thus, the three-dimensional structure illustrated in FIG. 1*a* depicts a completely non-interwoven structure.

Turning now to FIG. 1*b*, there is shown a three-dimensional structure exhibiting the characteristics of a partially-interwoven structure 22. Partially interwoven structure 22 contains four identical planar substructures 24, each consisting of four coplanar elements extending in the X-direction 26 and four coplanar elements extending in the Y-direction 28. X- and Y-direction elements 26, 28 are substantially perpendicular to one another. The four planar substructures 24 are interconnected or stitched together by sixteen substantially parallel elements extending in the Z-direction 30, not all of which are shown in their entirety. Z-direction elements 30 are substantially perpendicular to X- and Y-direction elements 24, 26. Partially interwoven structure 22 is shown expanded in the Z-direction for purposes of clarity.

The partially interwoven nature of the structure 22 is seen by examining the extent of interweavement, or lack thereof, exhibited by X-, Y-, and Z-direction elements 26, 28, 30. Thus, in FIG. 1*b*, it is seen that each X-direction element 26 in each substructure 24 extends in that substructure in such a way that it alternately passes over then under adjacent Y-direction elements 28 in that substructure. Simultaneously, and as a necessary corollary to the orientation of the X-direction elements 26, each Y-direction element 28 in a given substructure 24 extends in that substructure so that it alternately passes over then under adjacent X-direction elements 26 in that substructure. The result is that X- and Y-direction elements 26, 28 in each substructure 24 exhibit planar interweavement with one another. Substructures 24 may be generally described as planar weave patterns.

Further, in FIG. 1*b* it is seen that Z-direction elements 30 extend in partially interwoven structure 22 so that any given Z-direction element 30 intersects each planar substructure 24 at the same location in each of the planes defined by the X- and Y-direction elements of each substructure. Stated differently, each Z-direction element 30 passes through successive substructures 24 without shifting position relative to intersection 32 defined by the crossing of X- and Y-direction elements 26, 28 in a given substructure 24: i.e., Z-direction elements 30 pass "straight" through substructure 24. Hence, it is seen that Z-direction elements 30 exhibit no interweavement with either X-direction 26 or Y-direction 28 elements. Thus, since X- and Y-direction elements 26, 28 exhibit interweavement but Z-direction element 30 does not, it is understood that the three-dimensional structure illustrated in FIG. 1*b* depicts a partially interwoven structure.

Figure 2A:
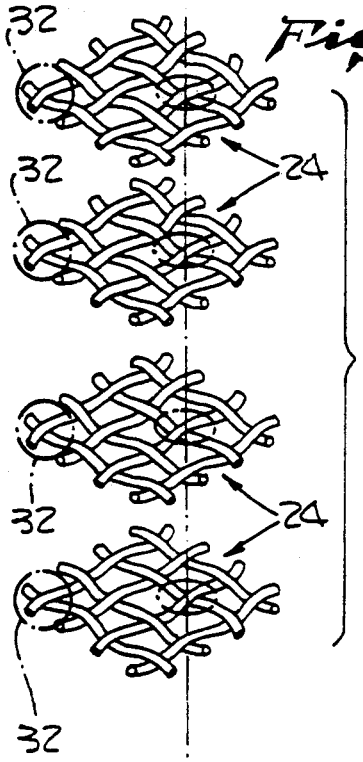
FIG. 2*a* is an illustration of four planar weave patterns that are identical to one another.
Figure 2B:
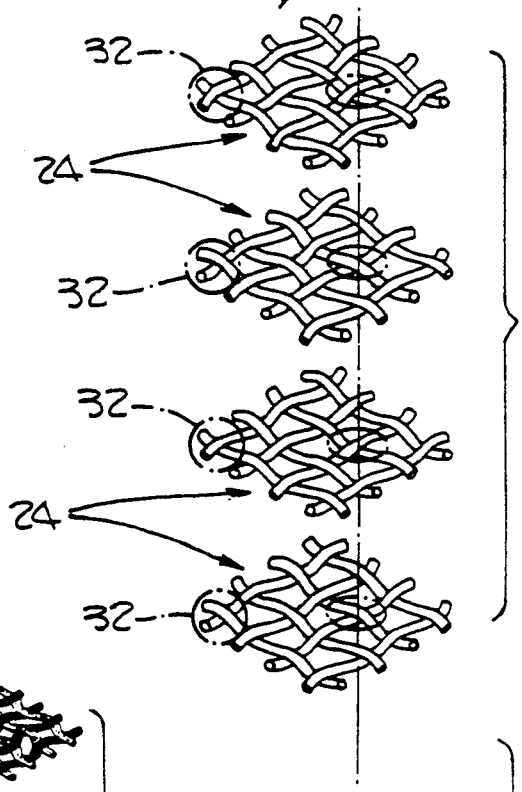
FIG. 2*b* is an illustration of four planar weave patterns that are mirror images of one another.

It is to be further understood that other partially-interwoven structures from that shown in FIG. 1*b* are possible. Thus, rather than X- and Y-direction elements 26, 28 forming planar weave patterns and Z-direction element 30 running "straight" through, X- and Z-direction elements 26, 30 could form planar weave patterns with Y-direction element 28 running "straight" through. Also, the format of the planar weave patterns may be varied without disturbing the partially interwoven nature of structure 22. Thus, in FIG. 1*b*, it is seen that all four substructures 24 contain identical planar weave patterns. This is best seen in FIG. 2*a*, which shows a configuration in which all corresponding X- and Y-element intersections 32 in adjacent substructures 24 exhibit identical "over/under" orientations, thereby making the planar weave patterns identical. In contrast, FIG. 2*b* shows adjacent planar weave patterns that are mirror images of one another. Accordingly, corresponding X- and Y-element intersections 32 in adjacent substructures 24 exhibit reversed "over/under" orientations. Mirror image planar weave patterns could be formed in a structure like that illustrated in FIG. 1*b*, with the structure retaining its partially-interwoven nature.

Turning now to FIG. 1*c*, there is shown a fully-interwoven three-dimensional structure 34 illustrating the principles of the present invention. Fully-interwoven structure 34 contains four planar substructures 36, each consisting of four coplanar elements extending in the X-direction 38 and four coplanar elements extending in the Y-direction 40. X- and Y-direction elements 38, 40 are substantially perpendicular to one another. The four planar substructures 36 are interconnected or stitched together by sixteen substantially parallel elements extending in the Z-direction 42, not all of which are shown in their entirety. Z-direction elements 42 are substantially perpendicular to X- and Y-direction elements 38, 40. Fully-interwoven structure 34 is shown expanded in the Z-direction for clarity.

As best seen in FIG. 1*c*, the X-direction coplanar elements 38 in planar substructures 36 may be characterized as adjacent sets of lateral rods or fibers. Also, the Y-direction coplanar elements 40 in planar substructures 36 may be characterized as adjacent sets of transverse rods or fibers. Further, the Z-direction elements 42 may also be characterized as consisting of adjacent sets of vertical rods or fibers. Thus, fully-interwoven structure 34 may be partially described as containing adjacent sets of lateral rods, adjacent sets of transverse rods, and adjacent sets of vertical rods with the lateral, transverse and vertical sets of rods coming together substantially mutually perpendicularly to one another.

The fully-interwoven nature of structure 34 is seen by examining the extent of interweavement exhibited by X-, Y- and Z-direction elements 38, 40 and 42. Thus, it is seen in FIG. 1*c* that X- and Y-direction elements 38, 40 of each substructure 36 form a planar weave pattern. Further, in FIG. 1*c* it is seen that each Z-direction element 42 extends in structure 34 in such a way as to exhibit the following two characteristics: the Z-direction element alternates the side, near or far, on which it passes corresponding Y-direction elements 40 in adjacent substructures 36, and it simultaneously alternates the side, near or far, on which it passes corresponding X-direction elements 38 in adjacent substructure 36. Thus, Z-direction elements 42 are interwoven with Y-direction elements 40 and are also simultaneously interwoven with X-direction elements 38.

The previously discussed planar weave patterns formed by X- and Y-direction elements 38, 40 may be identified as XY planar weave patterns. Similarly, as can be seen in FIG. 1*c*, Z-direction elements 42 interweave with X- and Y-direction elements, 38, 40 in such a fashion that X- and Z-direction elements 38, 42 create what may be identified as XZ-planar weave patterns and Y- and Z-direction elements 40, 42 create what may be identified as YZ-planar weave patterns.

This condition, the simultaneous formation of XY-, XZ and YZ-planar weave patterns, completely describes the construction of a "fully interwoven structure," as contemplated by the present invention. It also describes what is meant by the statement that the X-, Y- and Z-direction elements, 48, 40 and 42 are "fully interwoven" with each other.

Figure 3:
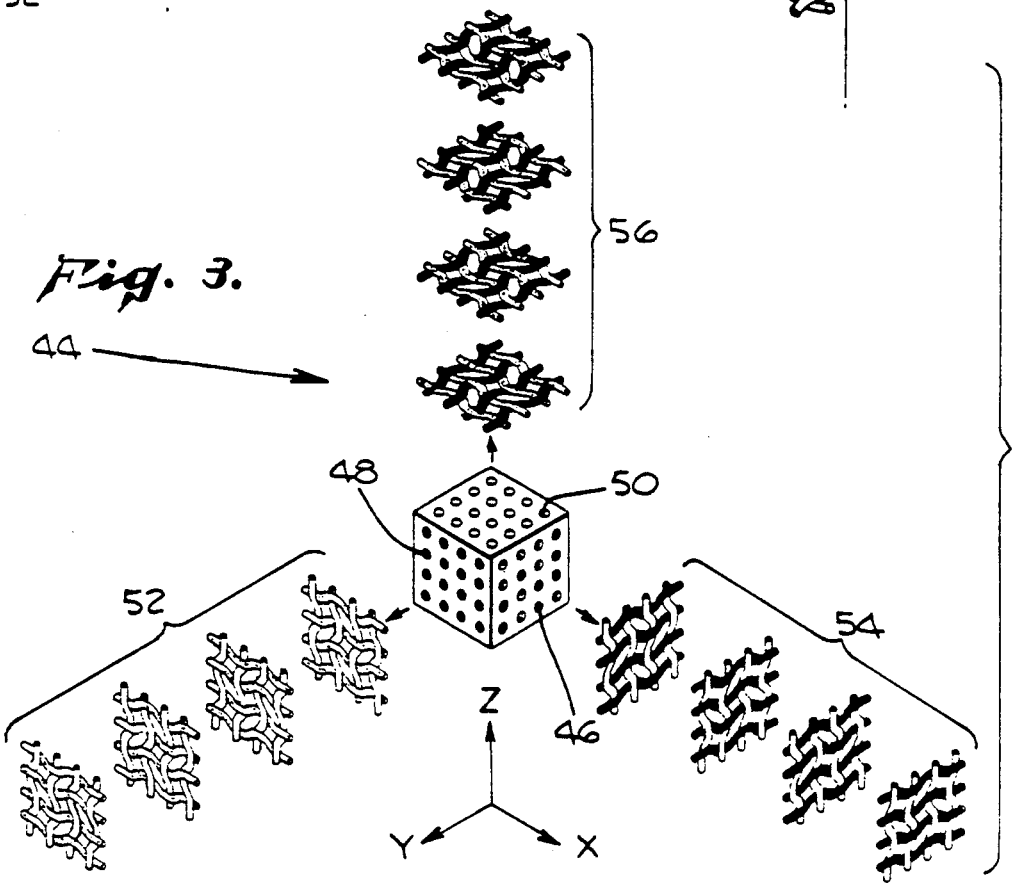
FIG. 3 is a schematic representation of the present invention including a three-axis exploded view illustrating three mutually perpendicular interdistributed sets of planar weave patterns.

FIG. 3 provides a further illustration of the nature of a fully-interwoven structure. In the center of FIG. 3 is shown a cube-like schematic representation of an embodiment of a fully-interwoven structure 44, with X-, Y- and Z-direction elements 46, 48, 50 represented by differently-styled circles on the cube's visible faces. As illustrated by FIG. 3, a fully-interwoven structure of the type contemplated by the present invention may be viewed as consisting of three sets of substantially mutually perpendicular planar weave patterns with each set having four planar weave patterns. Thus, FIG. 3 shows: a first set of four planar weave patterns 52 with each planar weave pattern consisting of X- and Z-direction elements 46, 50; a second set of four planar weave patterns 54, with each planar weave pattern consisting of Y- and Z-direction elements 48, 50; and a third set of four planar weave patterns 56, with each planar weave pattern consisting of X- and Y-direction elements 46, 48. The three sets of planar weave patterns 52, 54, 56 do not simultaneously exist as independent items in fully-interwoven structure 44. Rather, each planar weave pattern in each set shares one directional element with each planar weave pattern in each of the other two sets. Thus, the sets of planar weave patterns 52, 54, 56 are said to be "interdistributed" with one another.

From the foregoing, it is to be understood that a fully-interwoven structure of the type contemplated by the present invention incorporates the highest possible degree of interweavement of its constituent elements or fibers. Thus, it is further understood that such a fully-interwoven structure exhibits isotropic mechanical and structural properties and therefore does not contain the type of weak axes or planes found in non-fully-interwoven structures. Further, it is seen that in a fully-interwoven structure of the type contemplated herein, the constituent elements are interlocked to the maximal degree. Therefore, the structure can also be created as a self-maintaining, non-impregnated structure, and can additionally be created non-compactly (thus forming a "skeletal structure").

Figure 5:
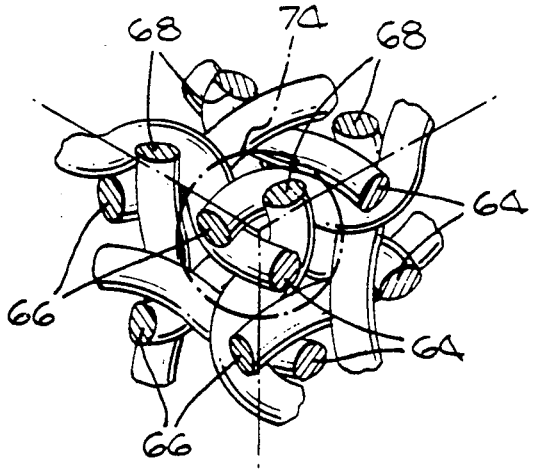
FIG. 5 is a fragmentary perspective view of a right-handed weavement embodiment.
Figure 4:
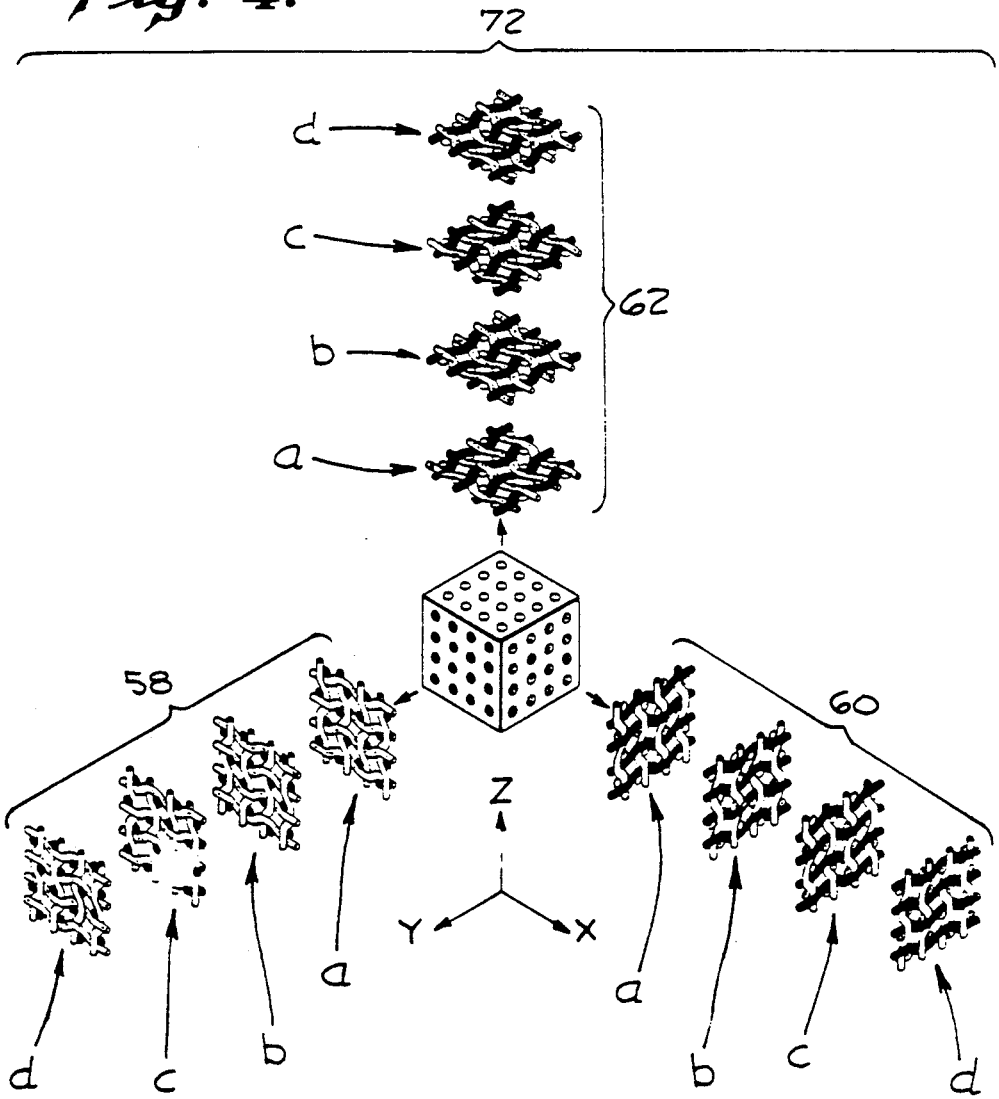
FIG. 4 is a schematic representation of the present invention illustrating a "right-handed" weavement embodiment.
Figure 6:
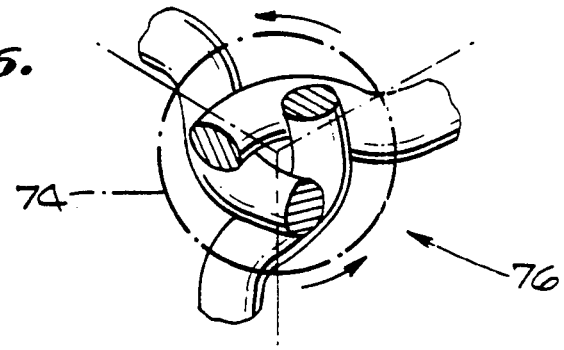
FIG. 6 is an enlarged detail of a right-handed incipient twist.

In fully interwoven three-dimensional structures of the type described hereinabove, the X-, Y- and Z-direction elements may be fully interwoven with one another in a number of ways. FIGS. 4–6 illustrate one embodiment of a fully interwoven structure identified as a "right-handed" weavement 72. As is best seen in FIG. 4, right-handed weavement 72 includes three substantially mutually perpendicular sets of interdistributed planar weave patterns 58, 60, 62, with each set having four identical planar weave patterns a, b, c, d. The identical nature of the weave patterns in each set is seen by noting that corresponding intersections in adjacent planar weave patterns exhibit identical "over/under" patterns. Reference is hereby made to FIG. 2*a* which illustrates a set of four planar weave patterns exhibiting identical "over/under" orientations of all corresponding intersections thereby making all four planar weave patterns identical. Hence, it is seen that planar weave patterns a, b, c, and d are identical in each set of planar weave patterns 58, 60 and 62.

Further, as is best seen in FIG. 5, X-, Y-, and Z-direction elements 64, 66, 68, come together at three-dimensional intersection "nodes" 74 that exist throughout right-handed weavement 72. The right-handed nature of right-handed weavement 72 is achieved by interweaving X-, Y- and Z-direction elements 64, 66, 68 in such a way that every intersection node 74 in right-handed weavement 72, if viewed independently and properly oriented, forms an identical "incipient right-handed twist" 76 (hence the name of this weavement: "right-handed weavement," or "the 'R'-type" for short). Such an incipient right-handed twist 76 is shown most clearly in FIG. 6 and a node so configured is called a "right-handed node." Thus, it is seen that a right-handed weavement 72 of a fully-interwoven structure of the type contemplated herein, has two characteristics: in each of its three sets of planar weave patterns 58, 60, 62, each planar weave pattern a, b, c, d is identical; and every intersection node 74 is a right-handed node. It should be noted that the second characteristic, by itself, provides a complete definition of a fully-interwoven right-handed weavement of the type contemplated by the present invention.

Figure 7:
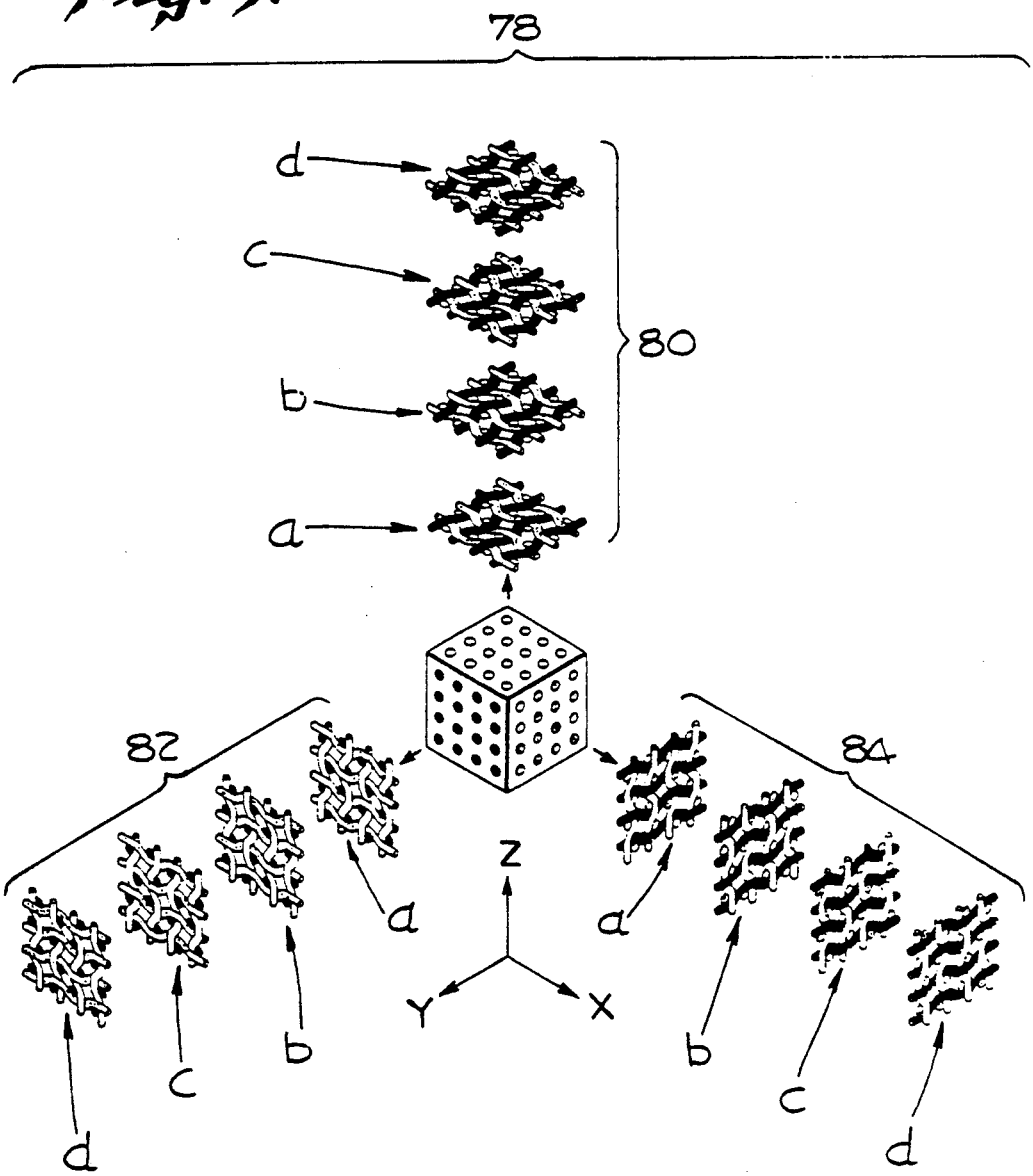
FIG. 7 is a schematic representation of the present invention illustrating a "left-handed" weavement embodiment.
Figure 8:
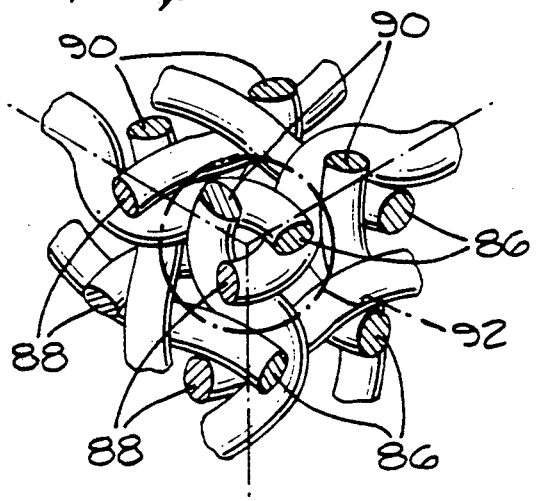
FIG. 8 is a fragmentary perspective view of a left-handed weavement embodiment.
Figure 9:
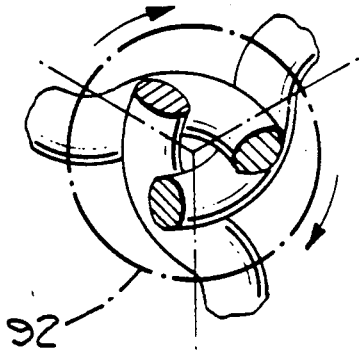
FIG. 9 is an enlarged detail of a left-handed incipient twist.

Similarly, another embodiment of the present invention, illustrated in FIGS. 7–9, is identified as a "left-handed" weavement 78. As is best seen in FIG. 7, left-handed weavement 78 includes three substantially mutually perpendicular sets of interdistributed planar weave patterns 80, 82, 84 with each set having four identical planar weave patterns a, b, c, d. As discussed hereinabove, and best illustrated in FIG. 2*a*, the identical nature of the planar weave patterns in each set is seen by noting that each corresponding intersection in adjacent planar weave patterns exhibit identical "over-/under" orientations.

Further, as is best seen in FIG. 8, X-, Y- and Z-direction elements 86, 88, 90 of left-handed weavement 78 come together at three-dimensional intersection nodes 92 that exist throughout left-handed weavement 78. The left handed nature of left-handed weavement 78 is achieved by interweaving X-, Y- and Z-direction elements 86, 88, 90 in such a way that every intersection node 92 in left-handed weavement 78, if viewed independently and properly oriented, forms an identical "incipient left-handed twist" 94 (hence the name of this weavement: "left-handed weavement," or "the 'L'-type" for short). Such an incipient left-handed twist 94 is shown most clearly in FIG. 9 and a node so configured is called a "left-handed node." Thus, it is seen that a left-handed weavement 78 of a fully-interwoven structure of the type contemplated herein has two characteristics: in each of its three sets of planar weave patterns 80, 82, 84, each planar weave pattern is identical; and every intersection node 92 is a left-handed node. It may be noted that the second characteristic, by itself, provides a complete definition of a fully-interwoven left-handed weavement of the type contemplated by the present invention.

Figure 10:
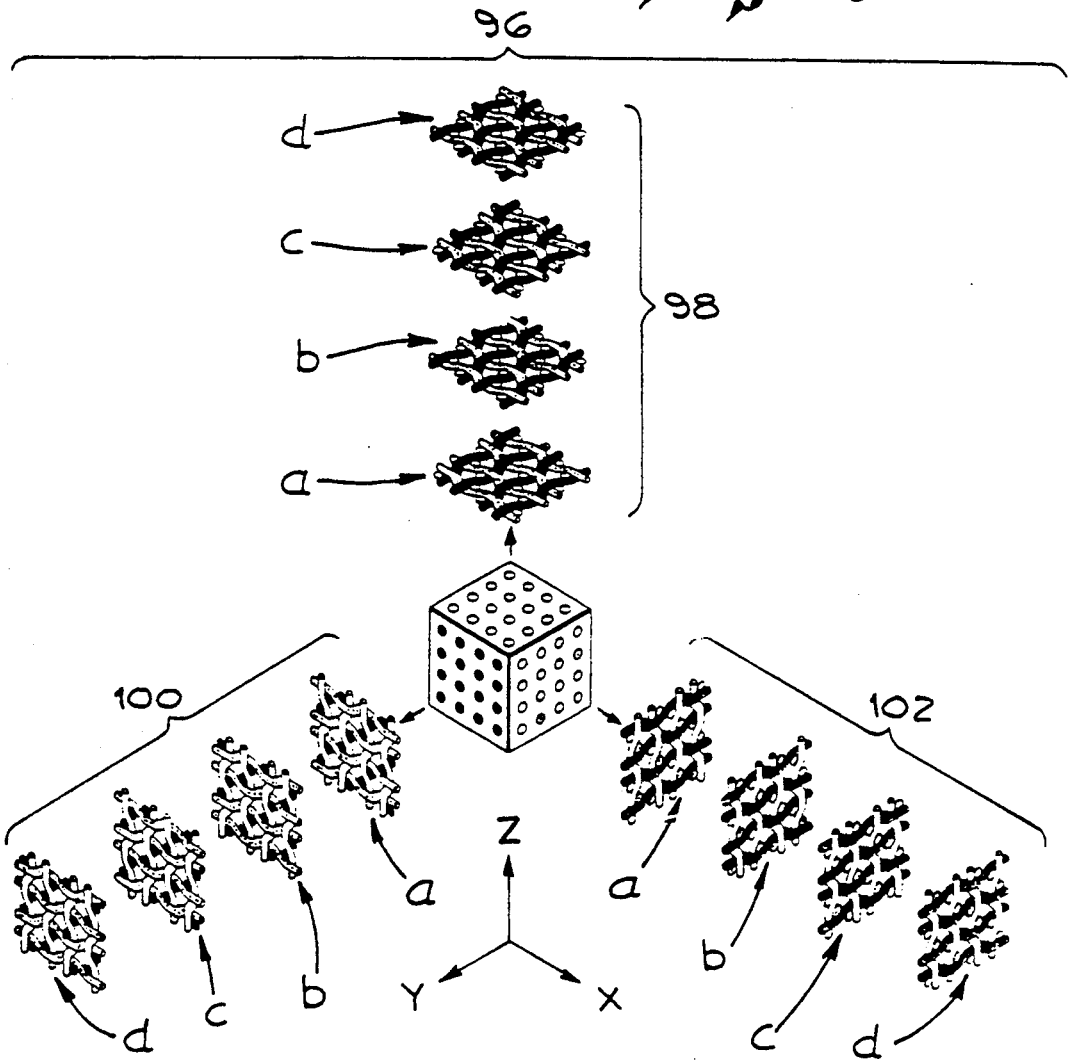
FIG. 10 is a schematic representation of the present invention illustrating an "even" weavement embodiment.
Figure 11:
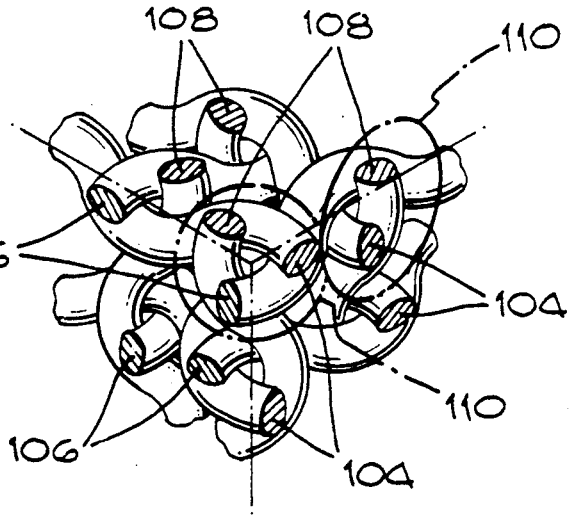
FIG. 11 is a fragmentary perspective view of an even weavement embodiment.

Yet another embodiment of the present invention, illustrated in FIGS. 10–11, is identified as an even weavement 96. As is best seen in FIG. 10, even weavement 96 includes three substantially mutually perpendicular sets of interdistributed planar weave patterns 98, 100, 102, with each set having four planar weave patterns a, b, c, d. Planar weave patterns a, b, c, d are arranged so that any two adjacent planar weave patterns in any set of planar weave patterns 98, 100, 102 are mirror images of one another. Reference is hereby made to FIG. 2*b* which illustrates a set of four planar weave patterns exhibiting reversed "over/under" orientations of corresponding intersections in adjacent planar weave patterns thereby making adjacent planar weave patterns mirror images of one another.

Further, as is best seen in FIG. 11, X-, Y-, and Z-direction elements 104, 106, 108 of even weavement 96 come together at three-dimensional intersection nodes 110 that exist throughout even weavement 96. X-, Y- and Z-direction elements 104, 106, 108 are interwoven in such a way that intersection nodes 110 include equal numbers of left-handed and right-handed nodes. These left-handed and right-handed nodes are distributed among each other in a manner that is maximally "even," presenting a "three-dimensional checkerboard pattern" (hence the name of this weavement: "even weavement" or "the 'E'-type" for short). Due to the described distribution, this weavement may be characterized as "non-handed."

It may be noted that the condition of having any two adjacent planar weave patterns in any set of planar weave patterns being mirror images of one another, provides a complete definition of a fully-interwoven even weavement of the type contemplated by the present invention.

Figure 12:
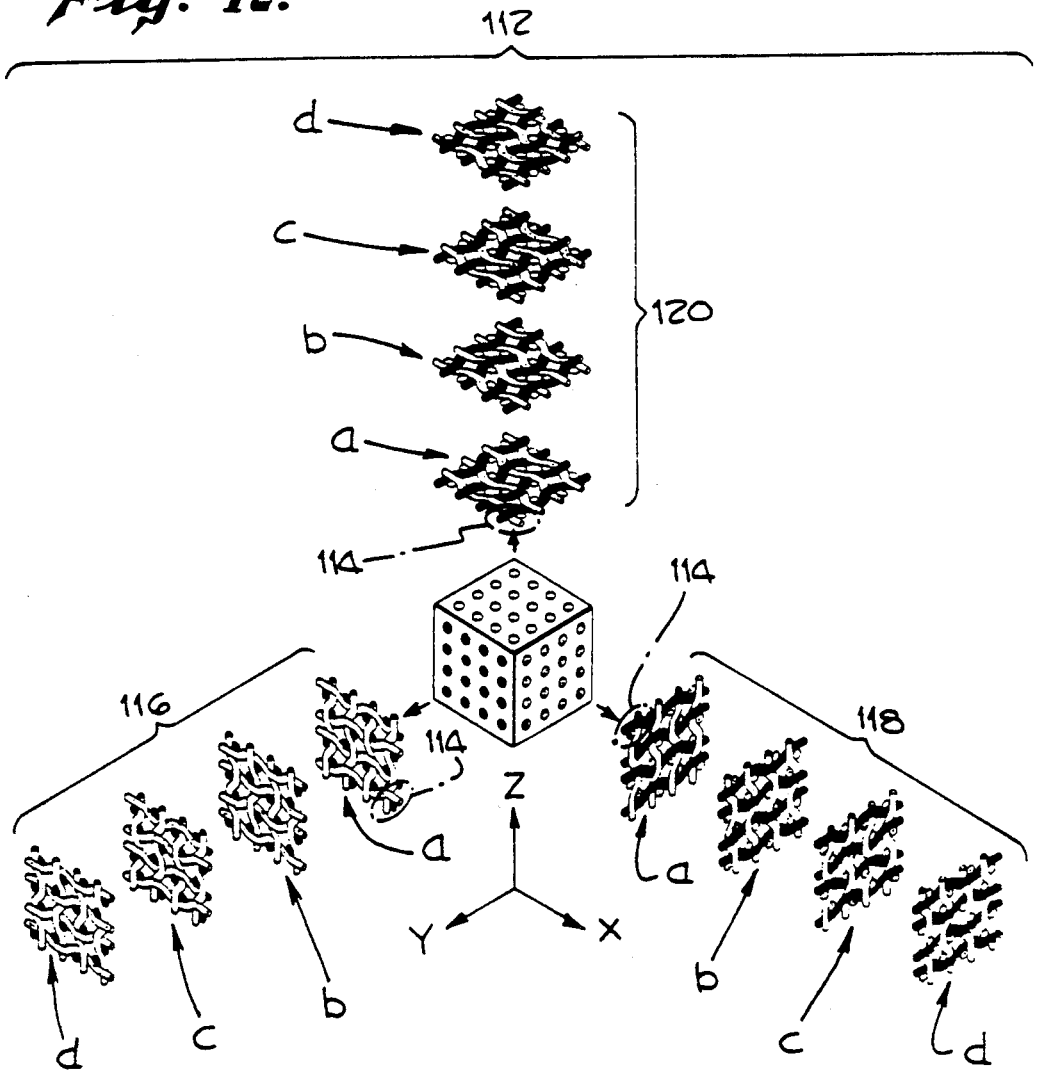
FIG. 12 is a schematic representation of the present invention illustrating a "stratum" weavement embodiment.

Similarly, two additional embodiments, illustrated in FIGS. 12–15, may also be described as non-handed variations of a fully-interwoven structure. In FIG. 12 is seen what is identified as a "stratum" weavement 112 which includes three substantially mutually perpendicular sets of interdistributed planar weave patterns 116, 118, 120, with each set having four planar weave patterns a, b, c, d. As can be seen in FIG. 12, stratum-weavement 112 has two essential characteristics: in each of two of its sets of planar weave patterns all the planar weave patterns are identical; and in its remaining "odd" set of planar weave patterns any two adjacent planar weave patterns are mirror images of one another. (It is therefore a "hybrid" construction.) It may be noted that these two conditions, by themselves, provide a complete definition of a fully-interwoven stratum weavement of the type contemplated by the present invention.

Figure 14:
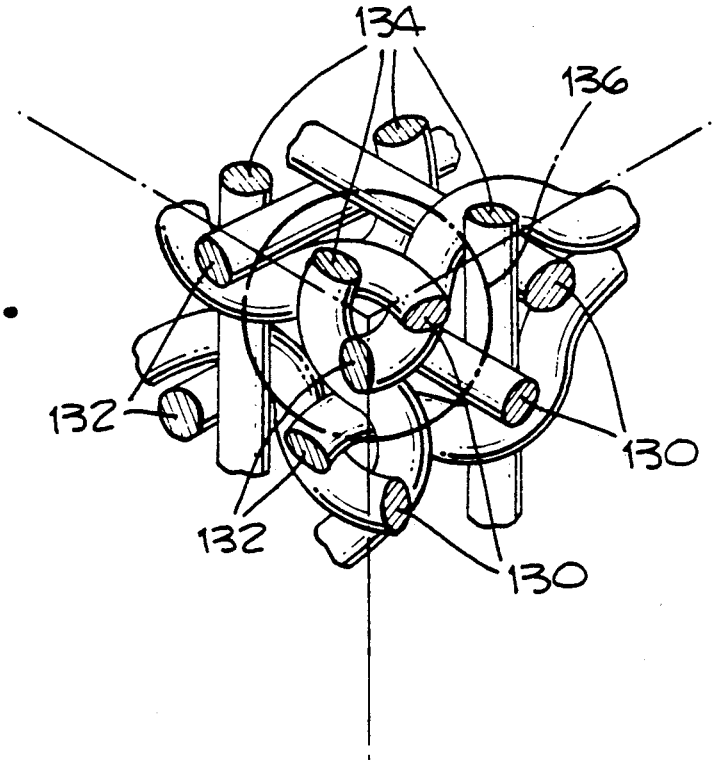
FIG. 14 is a fragmentary perspective view of a stratum weavement embodiment.

Further, as is best seen in FIG. 14, the X-, Y- and Z-direction elements 130, 132, 134 of stratum weavement 112 are interwoven in such a way as to form three-dimensional intersection nodes 136 which include equal numbers of left-handed and right-handed nodes. These left-handed and right-handed nodes are distributed among each other in such a fashion that single-layer strata of only right-handed nodes alternate with single-layer strata of only left-handed nodes. These strata are coincident, in a one-with-one fashion, with the planar weave patterns of the "odd" set of planar weave patterns (hence the name of this weavement: "stratum weavement," or "the 'S'-type" for short). Due to the described distribution, this weavement may be characterized as non-handed.

Figure 13:
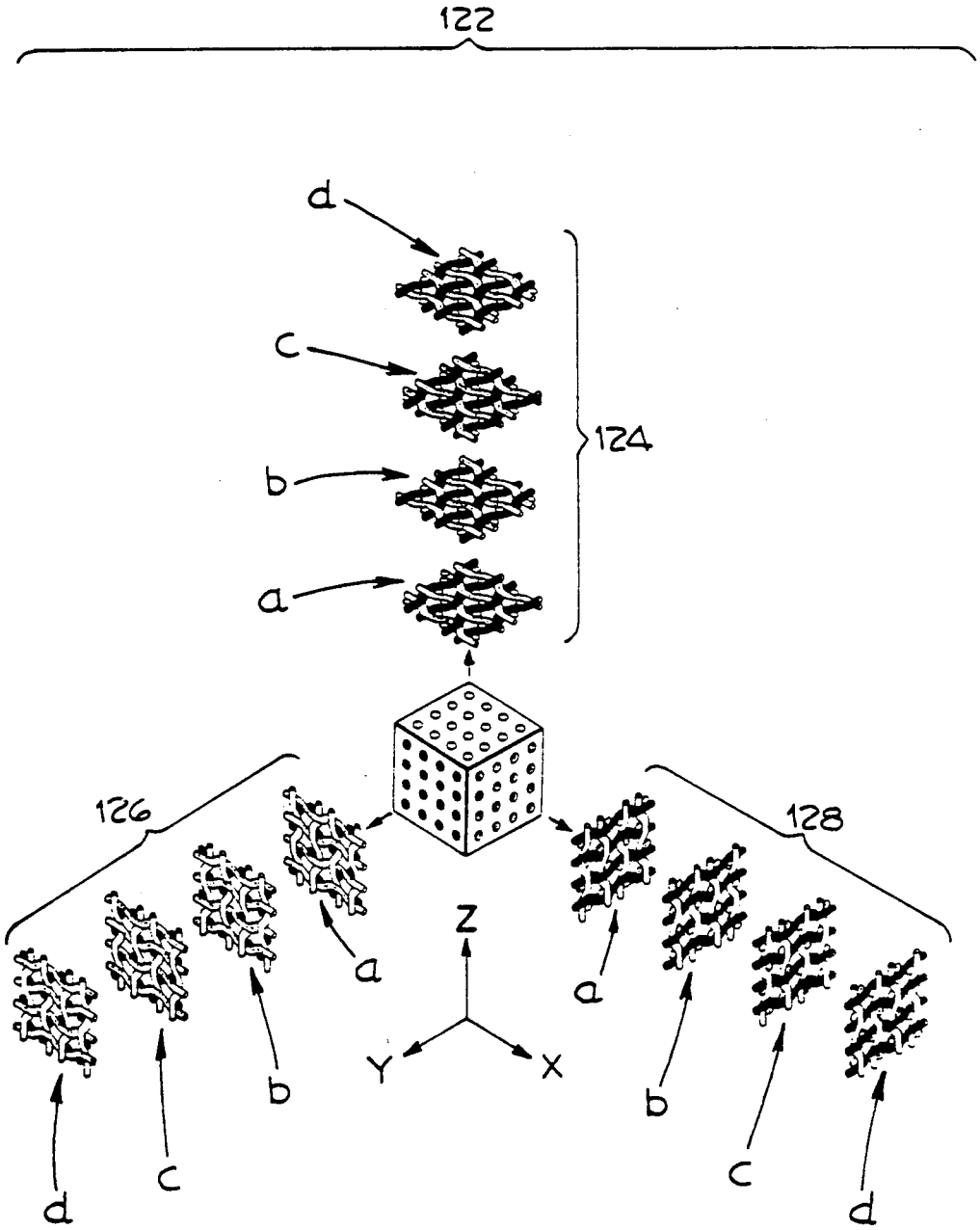
FIG. 13 is a schematic representation of the present invention illustrating a "column" weavement embodiment.

In FIG. 13 is seen a final embodiment of a non-handed weavement identified as a "column" weavement 122. It has three substantially mutually perpendicular sets of interdistributed planar weave patterns 124, 126, 128, with each set having four planar weave patterns a, b, c, d. As is seen in FIG. 13, column weavement 122 has two essential characteristics: in each of two of its sets of planar weave patterns any two adjacent planar weave patterns are mirror images of one another; and in its remaining "odd" set of planar weave patterns all the planar weave patterns are identical. (It is therefore a "hybrid" construction.) It may be noted that these two conditions, by themselves, provide a complete definition of a fully-interwoven column weavement of the type contemplated by the present invention.

Figure 15:
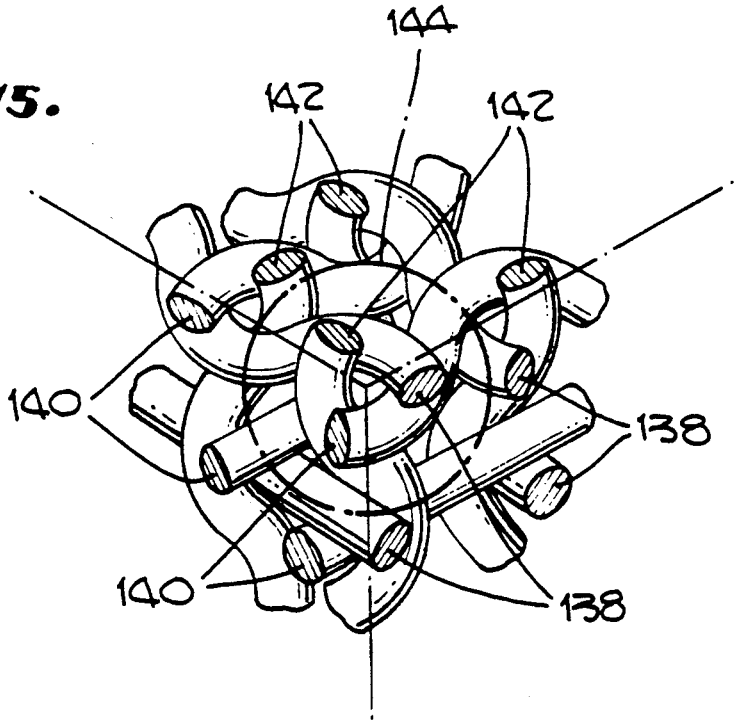
FIG. 15 is a fragmentary perspective view of a column weavement embodiment.

Further, as is best seen in FIG. 15, X-, Y- and Z-direction elements 138, 140, 142 are interwoven in such a way as to form three-dimensional intersection nodes 144 which include equal numbers of left-handed and right-handed nodes. These left-handed and right-handed nodes are distributed among each other in such a fashion that single-file columns of only right-handed nodes are distributed with single-file columns of only left-handed nodes. These two kinds of columns, seen "end on," are distributed among each other in a checkerboard pattern. These columns are coincident, in a one-with-one fashion, with the stitching elements of the "odd" set of planar weave patterns (hence the name of this weavement: "column weavement," or "the 'C'-type" for short). Due to the described distribution, this weavement may be characterized as non-handed.

It is to be understood that the foregoing description and accompanying drawings relate only to preferred embodiments of the present invention. Other embodiments may be utilized without departing from the spirit and scope of the invention. Thus, by way of example and not by limitation, a fully-interwoven structure may be fabricated from interwoven elements comprised of any number of materials such as graphite, fiberglass, synthetics, and cotton, to name just a few. Also, the interwoven elements in a given fully-interwoven structure may include more than one weaving material depending upon the particular application contemplated for the structure. Further, to accommodate particular applications, the fully-interwoven structure may be fabricated in a closely-woven, compact form or a non-closely woven, non-compact form. Accordingly, it is to be further understood that the description and drawings set forth hereinabove are for illustrative purposes only and do not constitute a limitation on the scope of the invention.

I claim:

1. A three-dimensional woven structure comprising:

a plurality of adjacent sets of lateral rods;

a plurality of adjacent sets of transverse rods; and a plurality of adjacent sets of vertical rods, said lateral, transverse and vertical sets of rods coming together substantially mutually perpendicularly to one another at a plurality of intersection nodes, each of said intersection nodes being formed so that said lateral, transverse and vertical rods are fully interwoven with one another.

2. A three-dimensional woven structure as defined in claim 1, further comprising each of said intersection nodes being formed into a right-handed weavement of said lateral, transverse and vertical rods.

3. A three-dimensional woven structure as defined in claim 1, further comprising each of said intersection nodes being formed into a left-handed weavement of said lateral, transverse and vertical rods.

4. A three-dimensional woven structure as defined in claim 1 further comprising said substantially mutually perpendicular lateral, transverse and vertical sets of rods forming three substantially mutually perpendicular interdistributed sets of planar weave patterns so that any two adjacent planar weave patterns in any one of said sets of planar weave patterns are mirror images of one another.

5. A three-dimensional woven structure as defined in claim 1 further comprising said substantially mutually perpendicular lateral, transverse and vertical sets of rods forming three substantially mutually perpendicular interdistributed sets of planar weave patterns so that all planar weave patterns in two of said sets of planar weave patterns are identical to one another and any two adjacent planar weave patterns in said third set of planar weave patterns are mirror images of one another.

6. A three-dimensional woven structure as defined in claim 1 further comprising said substantially mutually perpendicular lateral, transverse and vertical sets of rods forming three substantially mutually perpendicular interdistributed sets of planar weave patterns so that in two of said sets of planar weave patterns any two adjacent planar weave patterns are mirror images of one another and in said third set of planar weave patterns all planar weave patterns are identical.

7. A three-dimensional woven structure as defined in claim 2, further comprising:

at least four of said adjacent sets of lateral rods, each of said sets having at least four of said lateral rods;

at least four of said adjacent sets of transverse rods, each of said sets having at least four of said transverse rods;

at least four of said adjacent sets of vertical rods, each of said sets having at least four of said vertical rods; and said substantially mutually perpendicular lateral, transverse and vertical sets of rods coming together at at least sixty-four of said intersection nodes.

8. A three-dimensional woven structure as defined in claim 3, further comprising:

at least four of said adjacent sets of lateral rods, each of said sets having at least four of said lateral rods;

at least four of said adjacent sets of transverse rods, each of said sets having at least four of said transverse rods;

at least four of said adjacent sets of vertical rods, each of said sets having at least four of said vertical rods; and said substantially mutually perpendicular lateral, transverse and vertical sets of rods coming together at at least sixty-four of said intersection nodes.

9. A three-dimensional woven structure as defined in claim 4 further comprising each of said interdistributed sets of planar weave patterns having at least four planar weave patterns.

10. A three-dimensional woven structure as defined in claim 5 further comprising each of said interdistributed sets of planar weave patterns having at least four planar weave patterns.

11. A three-dimensional woven structure as defined in claim 6 further comprising each of said interdistributed sets of planar weave patterns having at least four planar weave patterns.

* * * * *